US010221733B2

(12) United States Patent
Boehringer et al.

(10) Patent No.: US 10,221,733 B2
(45) Date of Patent: Mar. 5, 2019

(54) LUBRICANT CONDUCTING HOUSING WITH A SEPARATION FUNCTION AND RECIRCULATION

(71) Applicant: Bayerische Motoren Werke Aktiengesellschaft, Munich (DE)

(72) Inventors: Marcel Boehringer, Munich (DE); Frank Horn, Strasslach (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 55 days.

(21) Appl. No.: 15/600,217

(22) Filed: May 19, 2017

(65) Prior Publication Data

US 2017/0254238 A1 Sep. 7, 2017

Related U.S. Application Data

(63) Continuation of application No. PCT/EP2015/077038, filed on Nov. 19, 2015.

(30) Foreign Application Priority Data

Dec. 10, 2014 (DE) ..... 10 2014 225 360

(51) Int. Cl.
*F01M 11/02* (2006.01)
*F01M 11/00* (2006.01)
(Continued)

(52) U.S. Cl.
CPC ..... *F01M 11/02* (2013.01); *F01M 11/00* (2013.01); *F01M 11/0004* (2013.01);
(Continued)

(58) Field of Classification Search
CPC .... F01M 11/02; F01M 11/00; F01M 11/0004; F01M 11/064; F01M 2011/005; F01M 2011/0066; F01M 2011/0091; F02F 7/00
(Continued)

(56) References Cited

U.S. PATENT DOCUMENTS 6,729,292 B1 5/2004 Bock et al.
2003/0042078 A1* 3/2003 Baeumler ..... F01M 11/0004 184/6.23
(Continued)

FOREIGN PATENT DOCUMENTS

DE 41 39 195 A1 6/1993
DE 100 26 113 A1 11/2001
(Continued)

OTHER PUBLICATIONS

German-language Office Action issued in counterpart German Application No. 10 2014 225 360.8 dated Oct. 20, 2015 (5 pages).
(Continued)

*Primary Examiner* — Syed O Hasan
(74) *Attorney, Agent, or Firm* — Crowell & Moring LLP

(57) ABSTRACT

A lubricant conducting member includes a lubricant conducting housing arranged between a crankcase and a lubricant collecting trough. The lubricant housing is surrounded by a bordering edge, and a projection of the bordering edge delimits an area in a plane parallel to a standing plane of the motor vehicle. A cumulative area of all of the lubricant passage openings is smaller than ⅓ of the area. In a perpendicular view, from the standing plane of the motor vehicle onto the lubricant conducting housing, in particular the view from below at least one lubricant passage opening, all lubricant passage openings are completely covered by the lubricant recirculation system.

11 Claims, 2 Drawing Sheets

(51) Int. Cl.
*F01M 11/06* (2006.01)
*F02F 7/00* (2006.01)

(52) U.S. Cl.
CPC ..... *F01M 11/064* (2013.01); *F02F 7/00* (2013.01); *F01M 2011/005* (2013.01); *F01M 2011/0066* (2013.01); *F01M 2011/0091* (2013.01)

(58) Field of Classification Search
USPC ..... 123/196 R
See application file for complete search history.

(56) References Cited

U.S. PATENT DOCUMENTS

| | | | | |
|---|---|---|---|---|
| 2007/0021159 | A1* | 1/2007 | Kaneoya ..... | H01Q 1/243 455/575.3 |
| 2007/0272193 | A1* | 11/2007 | Muramatsu ..... | F01M 11/0004 123/196 R |

FOREIGN PATENT DOCUMENTS

| | | | |
|---|---|---|---|
| DE | 10 2008 009 873 | A1 | 9/2009 |
| DE | 10 2008 060 411 | A1 | 6/2010 |
| EP | 1 710 404 | A2 | 10/2006 |
| JP | 53-1545 | | 1/1978 |
| JP | 2010-96062 | A | 4/2010 |
| WO | WO 2012/073724 | A1 | 6/2012 |

OTHER PUBLICATIONS

International Search Report (PCT/ISA/210) issued in PCT Application No. PCT/EP2015/077038 dated Feb. 24, 2016 with English translation (7 pages).
German-language Written Opinion (PCT/ISA/237) issued in PCT Application No. PCT/EP2015/077038 dated Feb. 24, 2016 (5 pages).
Chinese-language Office Action issued in counterpart Chinese Application No. 201580050529.7 dated Aug. 9, 2018 with English translation (14 pages).

* cited by examiner

LUBRICANT CONDUCTING HOUSING WITH A SEPARATION FUNCTION AND RECIRCULATION

CROSS REFERENCE TO RELATED APPLICATIONS

This application is a continuation of PCT International Application No. PCT/EP2015/077038, filed Nov. 19, 2015, which claims priority under 35 U.S.C. § 119 from German Patent Application No. 10 2014 225 360.8, filed Dec. 10, 2014, the entire disclosures of which are herein expressly incorporated by reference.

BACKGROUND AND SUMMARY OF THE INVENTION

Embodiments of the invention relate to a lubricant conducting housing. An example of a conventional lubricant housing may be found in DE 10 2008 009 873 A1.

The inventive lubricating conducting housing is described below in conjunction with a passenger vehicle; this should not be understood as a restriction of the invention. In internal combustion engines, certain requirements are imposed on the lubricating oil, i.e. the engine oil, which is provided for lubricating and cooling moving parts, such as pistons and shafts. The engine oil can meet these requirements in the long term only if the engine oil is filtered during operation and sufficient settling times are provided. It is an aim firstly to keep the input of gas into the engine oil low and secondly to provide settling sections which permit what is referred to as "degasifying" of the engine oil. For these tasks, devices between oil collecting container (engine oil trough) and moving parts of the internal combustion engine have been provided, in particular crankshaft with connecting rods and pistons. Such devices are frequently referred to as "oil separator walls".

DE 10 2008 009 873 A1 discloses a lubricant housing with recirculation. In a housing of this type, lubricant passes from moving components and from the crankcase of the internal combustion engine onto the upper side of the lubricant housing. It then flows from the upper side via a lubricant recirculation duct back into the oil trough.

One object of the inventive lubricant conducting housing is to improve efficiency and to reduce the risk of foaming of a lubricant. This, and other objects are achieved by a lubricant conducting housing, in which, in a perpendicular view of the lubricant conducting housing, from the standing plane of the motor vehicle, i.e. in particular in the view from below of the housing, the lubricant passage opening is completely covered by a lubricant recirculation system. Covered in this sense should be understood in such a manner that the oil passage opening is covered by the lubricant recirculation system in such a manner that lubricant from above the lubricant housing cannot freely fall downward, but rather impinges in the falling line against the lubricant recirculation system and is conducted by the latter downward, and therefore in particular into the engine oil trough (lubricant collecting trough). Similarly, a "free" upward spraying of lubricant through the lubricant passage opening is prevented. In particular if lubricant can fall freely downward, a quantity of air is admitted to an oil reservoir into which the lubricant enters, the quantity of air having to be output again from the oil reservoir. In particular by means of the configuration according to the invention of the lubricant housing with a lubricant recirculation system, an improved lubricant housing can be provided since the input of air can be reduced.

The lubricant conducting housing should be understood within the context of this disclosure as meaning what is referred to as an oil separator wall. Devices of this type are provided to be mounted in an internal combustion engine between the moving components, such as the crankshaft, the connecting rods or the pistons, on the one hand, and, on the other side, the lubricant collecting trough or the oil trough in which an oil reservoir can be accommodated.

The inventive lubricant conducting housing is provided for use with a motor vehicle. Particular requirements for a housing of this type arise in a motor vehicle, in particular because of the driving movements and accelerations. Whereas, in static applications, it is generally sufficient to use the lubricant conducting housing to collect the lubricant returning from the moving components and to supply same to the lubricant collecting trough, it is of importance for mobile use, such as in particular in a motor vehicle, also to prevent or to reduce lubricant from spraying back out of the lubricant collecting trough in the direction of the moving components due to driving movements of the motor vehicle.

The inventive lubricant conducting housing may include lubricant passage openings by means of which lubricant is permitted to permit from the upper side of the lubricant conducting housing (side on which the moving components of the internal combustion engine are arranged) in the direction of the lubricant collecting trough; the openings are completely covered here by what are referred to as lubricant recirculation systems.

Within the context of this disclosure, the covering of the lubricant passage openings by the lubricant recirculation systems should be understood as meaning that, in a perpendicular view, from a standing plane of the motor vehicle onto the lubricant conducting housing (view from below), there is no clear opening for the passage of the lubricant through the lubricant conducting housing. This covering or overlapping of the lubricant passage openings by the lubricant recirculation systems firstly permits lubricant to pass from above the lubricant conducting housing through the lubricant passage openings in the direction of the lubricant collecting trough. Secondly, the passage of lubricant out of the lubricant collecting trough in the direction of the moving components of the internal combustion engine is at least made difficult or prevented.

Moreover, the inventive lubricant conducting housing may have a plastic as one component or is composed of a plastic. A plastic should preferably be understood as meaning a fiber reinforced plastic.

Further, the inventive lubricant conducting housing may have a light metal as a component, or is composed of a light metal. A light metal of this type preferably has, as a component, aluminum, magnesium or an alloy in which aluminum or magnesium or both are a component.

In particular, a lubricant conducting housing composed of plastic can be produced particularly cost-effectively and has a low weight. Furthermore, a lubricant conducting housing composed of a light metal has particularly high temperature stability.

Moreover, the inventive lubricant recirculation system may extend from the lubricant housing in the direction of the lubricant collecting trough. Furthermore, the lubricant recirculation system has an angle of inclination $\alpha$ preferably at least partially or preferentially at least over a region of 50% of its length or more. The angle of inclination $\alpha$ here describes the inclination of the lubricant recirculation system in relation to the standing plane of the motor vehicle. The angle of inclination α is selected from a range which is >10°, preferably >20°, preferentially >30° and particularly preferentially >40°. Furthermore, the range is <80°, preferably <70°, preferentially <60° and particularly preferentially <50°. Very particularly preferentially, the angle α is at least essentially 45° or smaller. In this context, at least essentially should be understood as meaning that the angle α is selected from a range between 42 and 45°. Investigations have shown that the selection of the angle of inclination α from the range according to the invention leads to the lubricant passing on the one hand securely and on the other hand in a settled manner from the upper side of the lubricant conducting housing into the lubricant collecting trough.

Further, the inventive lubricant recirculation system may be oriented with respect to the main travel direction of the motor vehicle parallel to the main travel direction. Furthermore preferably, the lubricant recirculation system is oriented with respect to the main travel direction of the motor vehicle from the front at the top, connecting region to the lubricant conducting housing, to the rear at the bottom. Investigations have shown that in particular an orientation of this type has a particularly positive effect on the lubricant recirculation behavior of the lubricant.

Moreover, the inventive lubricant recirculation system may at least partially have an open-edge cross section. Furthermore preferably, the open-edge cross section is defined in a cross-sectional plane which is arranged parallel to the standing plane of the motor vehicle. Furthermore preferably, the open-edge cross section is of V-shaped configuration and preferably U-shaped configuration. The opening of the cross section is preferably oriented rearwards in the main direction of travel of the motor vehicle. In particular, an open-edge cross section makes it possible to particularly readily degasify the lubricant and to enable same to easily flow back into the lubricant collecting trough.

Further, the open-edge cross section of the lubricant recirculation system may be at least partially asymmetrical. Asymmetrical should preferably be understood in this context as meaning that one limb of the V-shaped or U-shaped cross section is longer than the other limb. Further, when two lubricant recirculation systems are arranged next to each other, the respectively adjacent limbs of the cross sections are longer than the outer limbs. Investigations have shown that such at least partially asymmetrically configured lubricant recirculation systems lead to particularly good settling of the lubricant as same flows back into the oil collecting trough.

A lubricant supply system for an internal combustion engine for use with a motor vehicle has a crankcase which is configured for receiving a crankshaft. The lubricant collecting trough for receiving the lubricant is arranged below the crankshaft. A lubricant conveying device is configured to suck up lubricant from the lubricant collecting trough and to supply the lubricant to movable parts of the internal combustion engine for lubrication and cooling. The lubricant is sucked out of the lubricant collecting trough via a suction line which is arranged in a suction region thereof. The inventive lubricant conducting housing may be arranged here between the crankcase and the lubricant collecting trough.

Further, the suction region may be arranged, at least substantially, in the region of the lubricant recirculation system. Here, arranged substantially in this region should be understood as meaning that the smallest distance of the intake region from the lubricant recirculation system is smaller than 250 mm, preferably smaller than 150 mm, preferentially smaller than 100 mm and particularly preferentially is smaller than or equal to 50 mm. Firstly, an arrangement of the suction region at a relatively great distance from the lubricant recirculation system leads to greater settling and defoaming of the lubricant as it moves back, and, secondly, relatively great distances from the lubricant recirculation system can lead to air being sucked up, and therefore the specified range for the spacing of the suction region from the lubricant recirculation system has proven a good compromise.

Additionally, the suction region may be arranged behind the lubricant recirculation system with respect to the main travel direction of the motor vehicle. In particular, the arrangement behind the lubricant recirculation system ensures that there is sufficient lubricant in the suction region of the lubricant supply system in acceleration phases of the motor vehicle.

Other objects, advantages and novel features of the inventive lubricant recirculation housing and system will become apparent from the following detailed description of one or more embodiments when considered in conjunction with the accompanying drawings, in which:

DETAILED DESCRIPTION OF THE DRAWINGS

Figure 1:
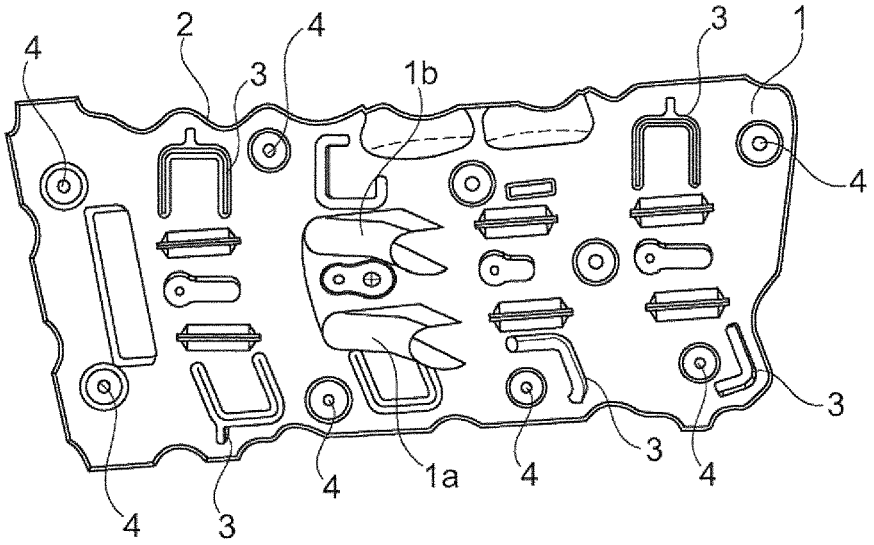
FIG. 1 is a perspective view of the inventive lubricant conducting housing.

FIG. 1 illustrates an inventive lubricant housing in a perspective view. The lubricant conducting housing 1 has fastening recesses 4. Reinforcing ribs 3 are provided for reinforcing the lubricant conducting housing 1. The lubricant recirculation systems 1*a*, 1*b* are arranged approximately in the center of the lubricant conducting housing 1. The lubricant recirculation systems 1*a*, 1*b* cover the lubricant passage openings (not illustrated) in this view. The lubricant conducting housing 1 is surrounded by a boundary edge 2.

Figure 2:
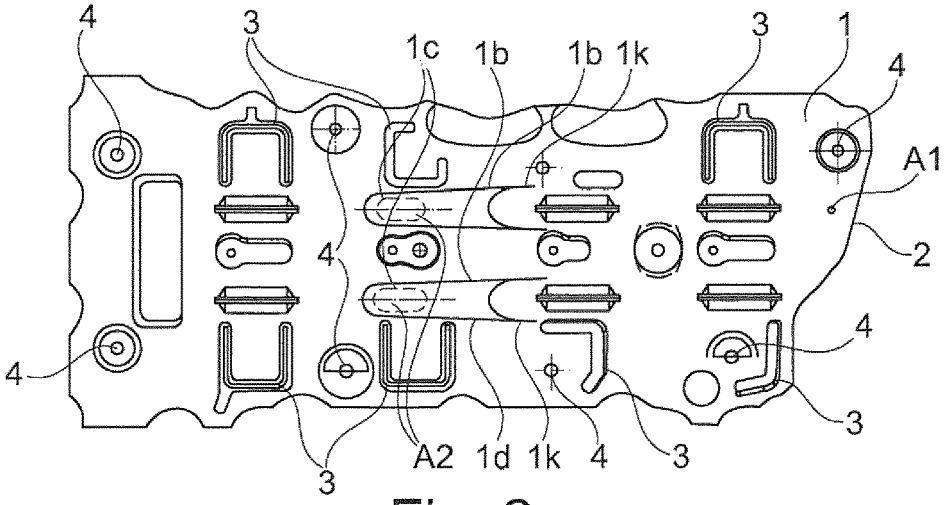
FIG. 2 is a view from below of the inventive lubricant conducting housing.

FIG. 2 illustrates a view from below of the lubricant conducting housing 1. The contour edge 2 completely surrounds the lubricant conducting housing 1 here. In the illustrated plane of projection of FIG. 2, the contour edge 2 surrounds the area A1. The lubricant passage openings 1*c* are illustrated as dashed lines since they are completely covered by the oil guides 1*a*, 1*b*. The lubricant recirculation systems 1*a*, 1*b* have an asymmetrical U-shaped cross section in this plane of projection. The asymmetrical cross section in each case has a short limb 1*k* and a long limb 1*l*. The lubricant conducting housing 1 is fastenable to the crankcase or to the oil collecting container (not illustrated) via the fastening bores 4. Reinforcing ribs 3 are provided for reinforcing the lubricant conducting housing. The area A2 is very small in comparison to the area A1. The small area firstly particularly readily separates off the moving components from the lubricant collecting trough and secondly the lubricant passage openings 1*c* and therefore the area A2 have to be of a large enough size that the oil still securely passes through the lubricant conducting housing.

Figure 3:
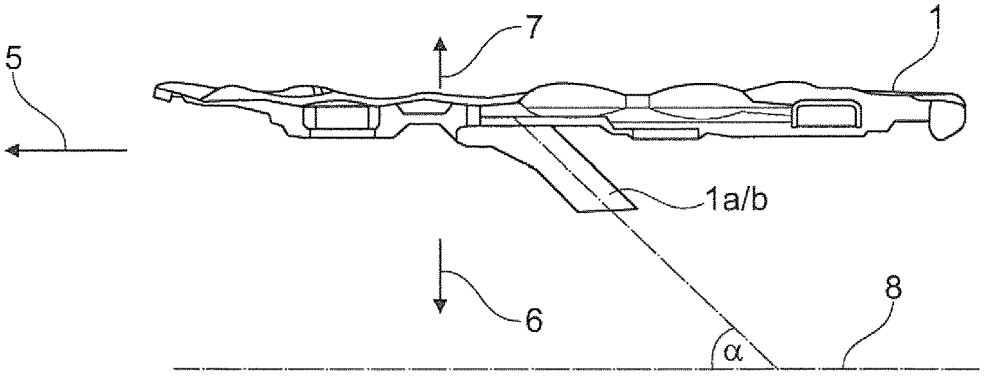
FIG. 3 is a side view of the inventive lubricant conducting housing.

FIG. 3 illustrates a side view of the lubricant conducting housing 1. In this view, the vehicle standing plane 8 is illustrated as a chain-dotted line. The angle of inclination α of the lubricant recirculation system 1*a*, 1*b* in relation to the vehicle standing plane 8 can be seen. The main direction of travel of the motor vehicle (straight ahead travel forward) is represented by the arrow 5. The crankshaft and further moving components of the internal combustion engine are arranged in direction 7. The oil collecting trough is arranged in direction 6.

Figure 4:
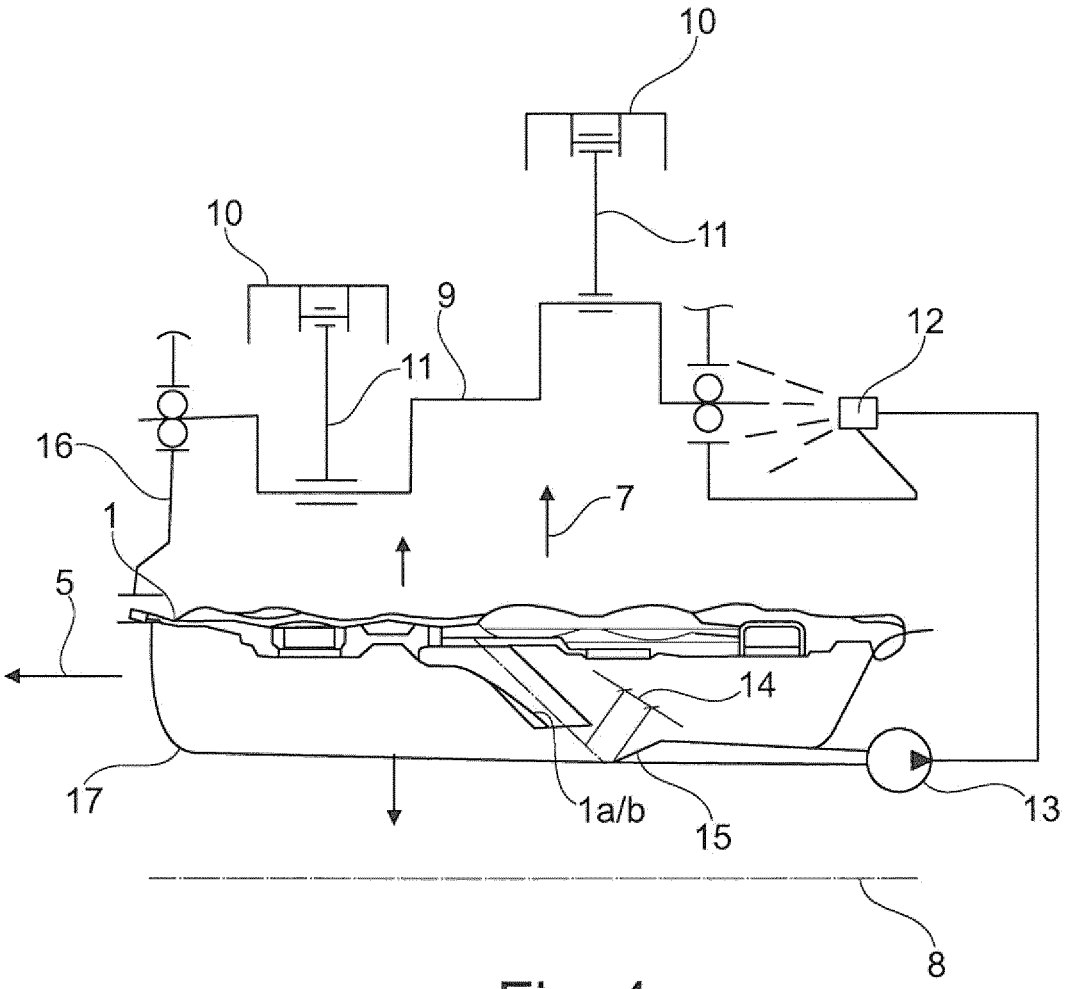
FIG. 4 is an inventive lubricant supply system.

FIG. 4 illustrates a lubricant supply system in a partially schematized manner. Starting from the lubricant conducting device 1, the crankshaft 9 is connected to the piston 10 via the connecting rod 11 in the direction 7 upward. The crankshaft 9 is mounted rotatably in the crankcase 16. The movable parts of the internal combustion engine are supplied with lubricant via the oil spray system 12. Lubricant is sucked out of the lubricant collecting trough 17 through the suction region 15 via the lubricant pump 13 and conveyed to the oil spray nozzle 12. The suction region 15 is arranged here behind the lubricant recirculation systems 1*a*, 1*b* with respect to the main direction of travel of the motor vehicle 5. The suction region 15 is arranged spaced apart from the lubricant recirculation systems 1*a*, 1*b* by the distance 14. The chain-dotted line 8 illustrates the motor vehicle standing plane.

The lubricant conducting housing is preferentially produced from a plastic, such as, for example, glass fiber reinforced polyamide or a light metal, such as, for example, aluminum or magnesium, preferably from an alloy with at least one of the materials as an alloy element.

For cost-effective manufacturing, the lubricant conducting housing is preferentially produced as an injection molded part from a plastic or from a light metal.

The foregoing disclosure has been set forth merely to illustrate the inventive housing and system and is not intended to be limiting. Since modifications of the disclosed embodiments incorporating the spirit and substance of the inventive housing and system may occur to persons skilled in the art, the invention should be construed to include everything within the scope of the appended claims and equivalents thereof.

What is claimed is:

1. A lubricant conducting member for an internal combustion engine having a crankcase and a lubricant collecting trough arranged geodetically below the crankcase in a motor vehicle, the lubricant conducting member comprising: a lubricant conducting housing arranged between the crankcase and the lubricant collecting trough having at least one lubricant passage opening and a lubricant recirculation system, wherein the lubricant recirculation system is configured to supply lubricant from the upper side of the lubricant conducting housing, in particular on sides of the crankcase, to the lubricant collecting trough, the lubricant housing is surrounded by a bordering edge, and a projection of the bordering edge delimits an area in a plane parallel to a standing plane of the motor vehicle, a cumulative area of all of the lubricant passage openings is smaller than ⅓ of the area, in a perpendicular view, from the standing plane of the motor vehicle onto the lubricant conducting housing, in particular the view from below at least one lubricant passage opening, all lubricant passage openings are completely covered by the lubricant recirculation system, the lubricant recirculation system has a V-shaped or U-shaped cross section, the cross section having a short limb and a long limb, and the lubricant recirculation system runs at an angle of inclination that is greater than 10° and smaller than 80°.

2. The lubricant conducting member as claimed in claim 1, wherein the lubricant conducting housing is at least partially or completely composed of a plastic.

3. The lubricant conducting member as claimed in claim 2, wherein the lubricant conducting housing is an injection molded part.

4. The lubricant conducting member as claimed in claim 3, wherein the lubricant housing is at least partially or completely composed of a light metal, preferably aluminum or preferentially an aluminum alloy.

5. The lubricant conducting member as claimed in claim 4, wherein the lubricant recirculation system extends from the lubricant housing in the direction of a lubricant collecting trough, the lubricant recirculation system runs at least partially or at least over a region of 50% of its length or more at the angle of inclination, and the angle of inclination is between 42° and 45°.

6. The lubricant conducting member as claimed in claim 5, wherein the lubricant recirculation system is oriented with respect to the main direction of travel of a motor vehicle parallel to the main direction of travel and from the front at the top to the rear at the bottom.

7. The lubricant conducting member as claimed in claim 6, wherein the lubricant recirculation system has an open-edge cross section at least in a cross-sectional plane which is oriented parallel to a standing plane of the motor vehicle, and the opening of the cross section is oriented rearward with respect to the main direction of travel.

8. The lubricant conducting member as claimed in claim 7, wherein the open-edge cross section is at least partially asymmetrical.

9. A lubricant supply system for an internal combustion engine, the system comprising:

a crankcase which is configured to receive a crankshaft;

a lubricant collecting trough that collects a lubricant, a lubricant conveying device having an intake line, which is arranged in the lubricant collecting trough and via which lubricant is sucked in a suction region in the lubricant collecting trough, and the lubricant conducting member as claimed in claim 1, which is arranged spatially between the crankcase and the lubricant collecting trough.

10. The lubricant supply system as claimed in claim 9, wherein the suction region is at least arranged in the region of at least one of the lubricant recirculation systems, preferably all of the lubricant recirculation systems, and preferably the distance of the suction region from at least one of the lubricant recirculation system is smaller than 250 mm.

11. The lubricant supply system as claimed in claim 10, wherein the suction region is arranged behind at least one or all of the lubricant recirculation systems with respect to the main direction of travel.

* * * * *